US007034702B2

(12) United States Patent
Thomas et al.

(10) Patent No.: US 7,034,702 B2
(45) Date of Patent: Apr. 25, 2006

(54) OPTICAL SMOKE DETECTOR AND METHOD OF CLEANING

(75) Inventors: Robert M. Thomas, Taufkirchen (DE); John M. McNamara, Pittsford, NY (US); Scott T. Castle, Canandaigua, NY (US); Thomas L. Hauder, Lincoln, NE (US)

(73) Assignee: Robert Bosch GmbH, Stuttgart (DE)

( * ) Notice: Subject to any disclaimer, the term of this patent is extended or adjusted under 35 U.S.C. 154(b) by 196 days.

(21) Appl. No.: 10/744,878

(22) Filed: Dec. 23, 2003

(65) Prior Publication Data

US 2005/0134468 A1 Jun. 23, 2005

(51) Int. Cl.
*G08B 17/10* (2006.01)

(52) U.S. Cl. ..... 340/628; 340/693.6; 356/438

(58) Field of Classification Search ..... 340/628
See application file for complete search history.

(56) References Cited

U.S. PATENT DOCUMENTS

| | | | | |
|---|---|---|---|---|
| 4,059,858 | A | 11/1977 | Lambel et al. | |
| 4,124,298 | A | 11/1978 | Steele | |
| 4,764,758 | A * | 8/1988 | Skala | 340/627 |
| 4,897,634 | A | 1/1990 | Sawa et al. | |
| 5,008,559 | A | 4/1991 | Beyersdorf | |
| 5,420,440 | A | 5/1995 | Ketler et al. | |
| 5,424,842 | A | 6/1995 | Poorman | |
| 5,430,307 | A | 7/1995 | Nagashima | |
| 5,451,929 | A * | 9/1995 | Adelman et al. | 340/521 |
| 5,477,218 | A | 12/1995 | Manmoto et al. | |
| 5,546,074 | A | 8/1996 | Bernal et al. | |
| 6,053,987 | A | 4/2000 | Tanimura et al. | |
| 6,166,648 | A * | 12/2000 | Wiemeyer et al. | 340/630 |
| 6,184,537 | B1 | 2/2001 | Knox et al. | |
| 6,285,291 | B1 | 9/2001 | Knox et al. | |
| 6,351,219 | B1 * | 2/2002 | Tanguay et al. | 340/630 |
| 6,756,905 | B1 * | 6/2004 | Rattman et al. | 340/630 |
| 2002/0084907 | A1 | 7/2002 | Rattman et al. | |

FOREIGN PATENT DOCUMENTS

| | | |
|---|---|---|
| GB | 2343946 | 5/2000 |
| WO | WO 03/069571 | 8/2003 |

OTHER PUBLICATIONS

Copy of European Search Report mailed Feb. 15, 2005, in related application No. EP 04029949.7.

* cited by examiner

*Primary Examiner*—Jeffery Hofsass
*Assistant Examiner*—George Bugg
(74) *Attorney, Agent, or Firm*—Baker & Daniels LLP

(57) ABSTRACT

An optical smoke detector for detecting particulates in an air sample. The detector includes a detection chamber defining an enclosure for the air sample. At least one opening is in fluid communication with the detection chamber whereby the air sample can be introduced and discharged from the detection chamber. A cleaning port defines a passageway to the detection chamber from a position external to the smoke detector and a resilient valve seals the cleaning port with a substantially air-tight seal. The valve member is accessible from a position external to the smoke detector. The valve member is openable, permitting passage of air through the cleaning port into the discharge chamber, by engaging the valve member with a nozzle, such as an air nozzle mounted on a canister of pressurized air.

19 Claims, 3 Drawing Sheets

OPTICAL SMOKE DETECTOR AND METHOD OF CLEANING

BACKGROUND OF THE INVENTION

1. Field of the Invention

The present invention relates to optical smoke detectors and, more specifically, to the detection chamber of an optical smoke detector and the cleaning thereof.

2. Description of the Related Art

Smoke detectors that employ optical sensors to detect the presence of smoke in a detection chamber are known in the art. Optical sensors operate based upon principles of scattered light absorption. Typically, a light emitting diode (LED) transmits light into a detection chamber where it is absorbed by a labyrinth structure. When smoke, due to a fire, is present in the air entering the detection chamber, the smoke particles scatter the light generated by the LED. A photodiode is used to measure the amount of light scattered by the particles and, when the quantity of scattered light exceeds a predetermined threshold, an alarm signal is generated. Detectors that combine thermal and/or chemical sensors with an optical sensor are also known in the art.

When employing an optical smoke detector, the accumulation of dust particles or other particulate matter within the detection chamber can have a detrimental impact on the performance of the smoke detector. The accumulation of such particulate matter in the detection chamber requires the eventual cleaning or replacement of the detection chamber to maintain the smoke detector in proper working order. The cleaning of a conventional optical smoke detector typically requires the disassembly of the detector to expose and gain direct access to the detection chamber. After gaining access to the detection chamber, clean air, such as from a container of clean pressurized air, may be used to clean the chamber. The disassembly and subsequent reassembly of the optical smoke detector can result in damage to various component parts of the detector which typically includes a printed circuit board. Disassembly and handling of the smoke detector and detection chamber can also leave oil from the hand of the maintenance personnel on surfaces within the detection chamber which could reflect light and interfere with the performance of the smoke detector. Although it is also known to disassemble and replace the detection chamber and then reassemble the smoke detector to provide the smoke detector with a clean detection chamber this too may result in the damage of various component parts of the detector and increases the cost of maintaining the detectors by increasing the quantity of required replacement parts.

An optical smoke detector having an improved design that facilitates the cleaning of the detection chamber of the smoke detector is desirable.

SUMMARY OF THE INVENTION

The present invention provides an optical smoke detector that includes a cleaning port that provides for the rapid and convenient cleaning of the detection chamber of the smoke detector without requiring the disassembly of the smoke detector.

The invention comprises, in one form thereof, an optical smoke detector for detecting the presence of particulates in an air sample and which is cleanable with the use of a supply of clean air introduced through an air nozzle. The smoke detector includes a detection chamber defining an enclosure for the air sample and at least one opening in fluid communication with the detection chamber wherein the air sample is introducible and dischargeable from the detection chamber through the at least one opening. A cleaning port defines a passageway to the detection chamber from a first position external to the optical smoke detector and a valve member seals the cleaning port with a substantially air-tight seal. The valve member is accessible from the first position external to the smoke detector and is openable, permitting the passage of air through the cleaning port into the discharge chamber.

The present invention comprises, in another form thereof, an optical smoke detector for detecting the presence of particulates in an air sample and which is cleanable with the use of a supply of clean air introduced through an air nozzle. The smoke detector includes a detection chamber defining an enclosure for the air sample, a plurality of openings are in fluid communication with the detection chamber wherein, during operation of the smoke detector in a detection mode, the air sample is introduced into the detection chamber through at least one of the plurality of openings and discharged from the detection chamber through another one of the plurality of openings solely by ambient air movement. A cleaning port defines a passageway to the detection chamber from a first position external to the smoke detector. A resilient valve member seals the cleaning port with a substantially air-tight seal. The valve member is accessible from the first position external to the smoke detector and is openable, permitting the passage of air through the cleaning port into the detection chamber, by engaging the valve member with the air nozzle.

In some embodiments of the invention, the detection chamber is defined by a chamber member having an end wall and a sidewall extending substantially transverse to the first end surface and circumscribing the detection chamber. The sidewall also engages a base member that defines a surface of the detection chamber opposite the end wall. The sidewall also includes a plurality of circumferentially spaced openings through which the air sample enters and exits the detection chamber. Additionally, the passageway defined by the cleaning port may extend through the surface of the detection chamber defined by the base member.

The valve may take various forms including one wherein it has a distal first end and a proximal second end, the first end being disposed more distally from the detection chamber than the second end. The first end of the valve defines a bore hole and the second end defines a sealing member providing a substantially air tight seal within the cleaning port. The sealing member defines a central passage extending from the bore hole through the second end wherein the central passage is closed in the absence of an external force and is openable to permit the passage of air when an air nozzle is introduced into the bore hole and clean air is introduced into the valve through the air nozzle.

The valve may also take a form wherein it has a substantially cylindrical central section with first and second opposite ends with the first and second ends respectively defining first and second radially outwardly extending flanges. The first and second flanges define first and second diameters respectively with the central section of the valve being positioned in an aperture having a third diameter. Each of the first and second diameters are greater than the third diameter whereby the valve is secured in the aperture. The smoke detector may be adapted for mounting on a support structure, such as a wall or ceiling, with the cleaning port positioned to face the support structure when the smoke detector is mounted on the support structure.

The present invention comprises, in yet another form thereof, a method of cleaning an optical smoke detector that detects the presence of particulates in an air sample. The method includes providing the smoke detector with a detection chamber for enclosing the air sample and a cleaning port defining a passageway to the detection chamber from a first position external to the smoke detector. The method also includes controlling the passage of air through the cleaning port with a valve member, the valve member sealing the cleaning port with a substantially air-tight seal during operation of the smoke detector in a detection mode, and opening the valve and introducing clean air into the detection chamber through the cleaning port to flush particulates from the detection chamber. The method may also include deactivating the smoke detector prior to opening the valve and introducing clean air into the detection chamber.

An advantage of the present invention is that it does not require the disassembly of the smoke detector when flushing smoke particles and other particulate matter from the detection chamber. Because the smoke detector does not have to be disassembled and reassembled during cleaning, the probability of damaging the smoke detector during cleaning of the detector is reduced. Additionally, the time required by the maintenance personnel during the routine cleaning of the smoke detector is reduced thereby facilitating the reduction of the cost of facility maintenance in a building employing smoke detectors in accordance with the present invention.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
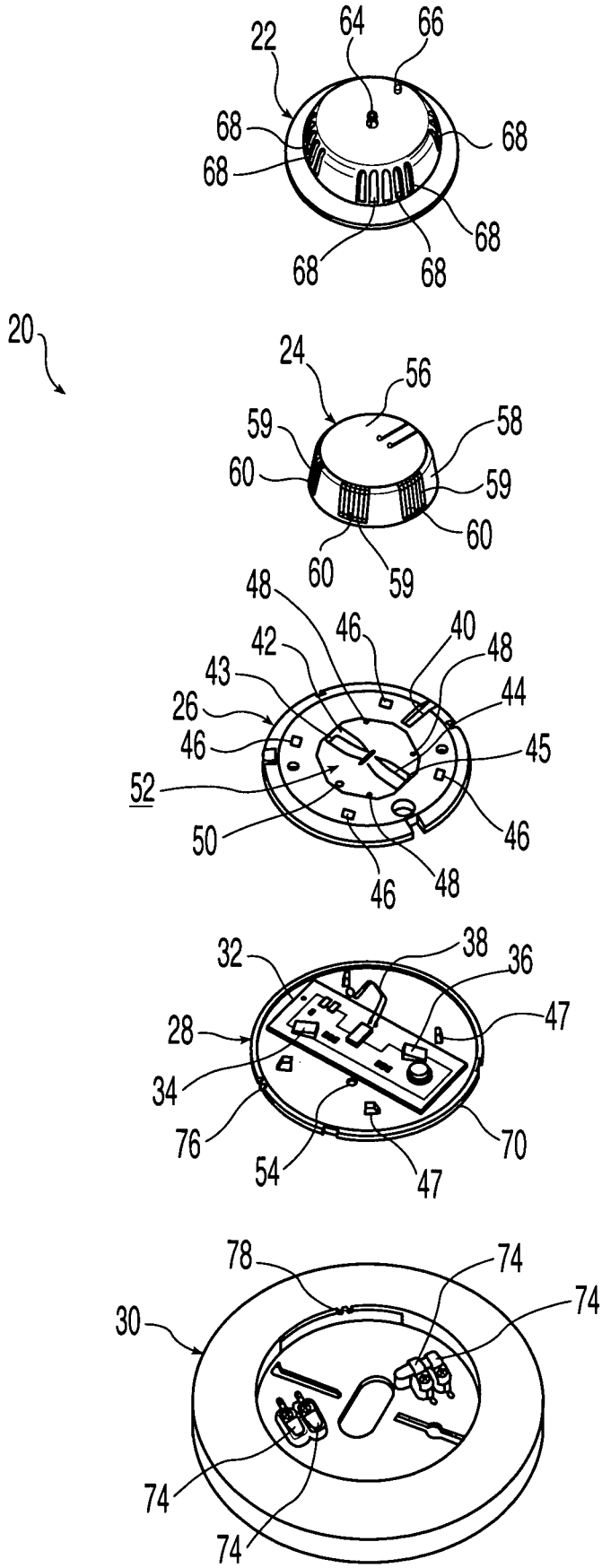
FIG. 1 is an exploded perspective view of a first embodiment of a smoke detector in accordance with the present invention.

Corresponding reference characters indicate corresponding parts throughout the several views. Although the exemplification set out herein illustrates an embodiment of the invention, the embodiment disclosed below is not intended to be exhaustive or to be construed as limiting the scope of the invention to the precise forms disclosed.

DESCRIPTION OF THE PRESENT INVENTION

In accordance with the present invention, an optical smoke detector 20 is shown in FIG. 1. Smoke detector 20 includes an outer housing 22, a chamber member 24, a base member 26 and a mounting plate 28. When assembled together smoke detector 20 can be removeably mounted on support structure 30 which takes the form of a mounting base.

A printed circuit board 32 is secured to mounting plate 28. Printed circuit board 32 includes a light emitting diode 34 and a photosensor 36. Printed circuit board 32 also has an assembly 38 that includes two conductive members extending outwardly from the printed circuit board. Assembly 38 has a thermal sensor located on its distal end.

Base member 26 is also secured to mounting plate 28 and is positioned over printed circuit board 32 with assembly 38 extending through slot 40. Two depressions 42, 44 are formed in base member 26. Depressions 42, 44 are aligned and slant downwardly as they extend away from each other towards their respective outermost ends 43, 45. Outer ends 43, 45 define openings which are respectively aligned with photodiode 34 and photosensor 36 when base member 26 is secured to mounting plate 28. Also shown in FIG. 1 are openings 46 which include a latching surface that is engaged with a flexible latch member 47 extending from mounting plate 28 to secure base member 26 to mounting plate 28. Locating holes 48 engage projecting pegs (not shown) projecting from structures 80 on chamber member 24 to properly locate chamber member 24 on base member 26. Also seen in FIG. 1 is an opening 50 that extends through surface 52 of base member 26 and is aligned with aperture 54 in mounting plate 28 when smoke detector 20 is assembled.

Figure 5:
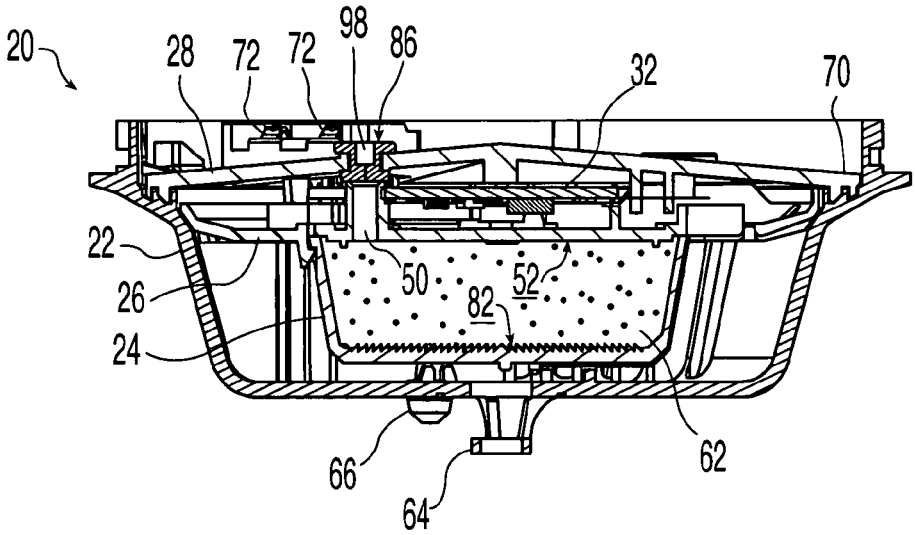
FIG. 5 is a cross sectional view of the first embodiment before the detection chamber is flushed with clean air.
Figure 6:
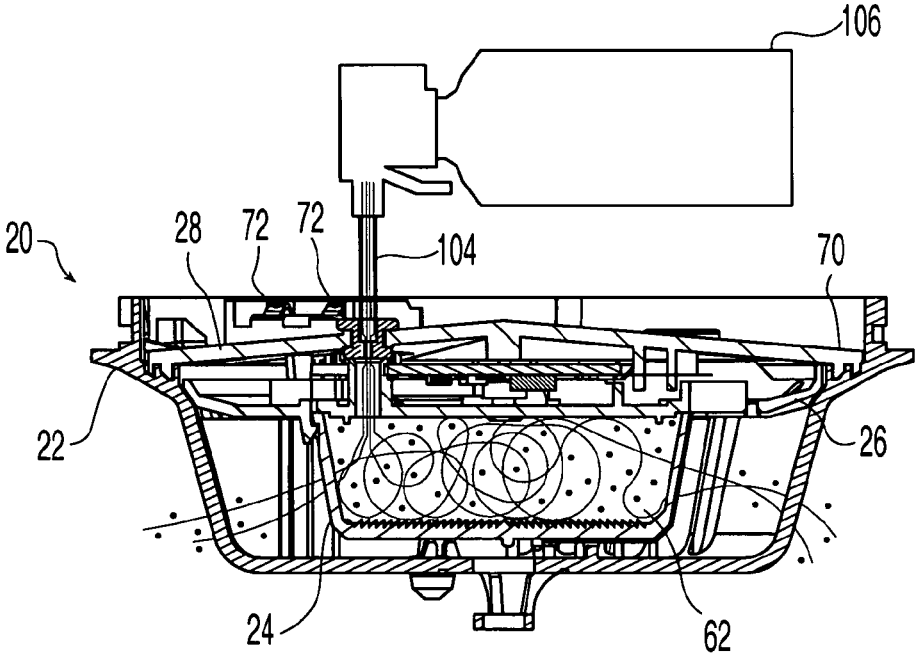
FIG. 6 is a cross sectional view of the first embodiment with the detection chamber being flushed with clean air.
Figure 7:
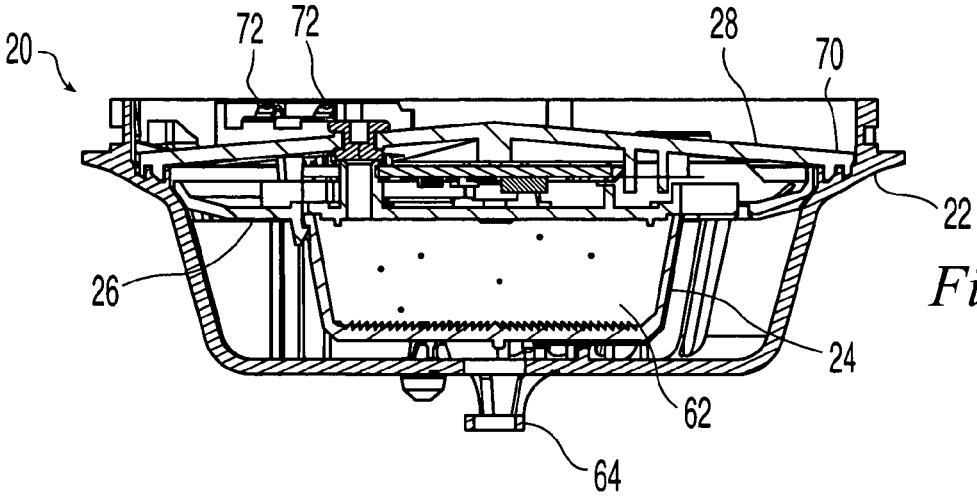
FIG. 7 is a cross sectional view of the first embodiment after the detection chamber has been flushed with clean air.

Chamber member 24 includes an upper chamber wall 56 and a sidewall 58. Sidewall 58 takes the general form of a conical section defining a progressively larger radius as it projects from end wall 56, however, the angle between walls 56 and 58 is such that sidewall 58 remains substantially transverse to end wall 56. A plurality of vertically extending elongate openings 60 are circumferentially spaced about sidewall 58 and are separated by vertically extending ribs 59. Chamber member 24 is engaged with surface 52 of base member 26 to define a detection chamber 62. Assembly 38 extends along the outer surfaces of sidewall 58 and end wall 56 with the distal end of assembly 38 being disposed within guard member 64 on outer housing 22. Outer housing 22 also includes a substantially transparent indicator 66. Indicator 66 extends toward printed circuit board 32 and allows a light emitting diode located on printed circuit board 32 to be used to communicate the status of smoke detector 20 to technicians or maintenance personnel. Outer housing 22 also includes openings 68 to communicate air between chamber 62 and a position external to smoke detector 20. After positioning base member 26 and chamber member 24 on mounting plate 28, mounting plate 28 and outer housing 22 are assembled together to form smoke detector 20. To secure mounting plate 28 and outer housing 22, the outer radial edge 70 of mounting plate 28 is snap fit to outer housing 22 as best seen in FIGS. 5–7. Although specific methods of securing mounting plate 28, base member 26, chamber member 24 and outer housing 22 are shown and described herein, other methods of securing such parts together are known to those having ordinary skill in the art, such as threaded fasteners and adhesives, and may also be used with the present invention.

As seen in FIGS. 5–7, the lower surface of mounting plate 28 includes electrical contacts 72. When detector 20 is secured in mounting base 30, contacts 72 engage electrical contacts 74 whereby electrical power and communication signals are communicated with smoke detector 20. Mounting base 30 is permanently secured to a building structure and contacts 74 may be connected with the electrical power and communications network of the building's fire alarm control. Smoke detector 20 is easily secured to mounting base 30 by threading inwardly extending ribs 78 through openings 76 on the mounting plate 28 and then rotating smoke detector 20 whereby smoke detector is mechanically secured to mounting base 30 and contacts 72 and 74 are brought into mutual engagement. By manually rotating smoke detector 20 in the opposite direction, smoke detector 20 may be removed from mounting base 30 and contacts 72 disconnected from contacts 74. Other methods of installing smoke detector 20 in a desired location may also be used with the present invention.

Figure 2:
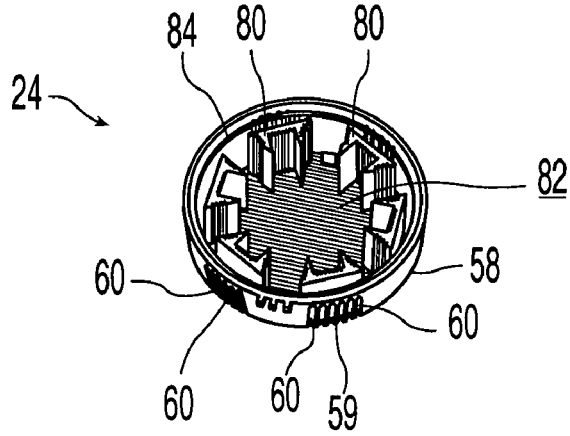
FIG. 2 is a perspective view of the detection chamber of the first embodiment.

The operation of smoke detector 20 will now be discussed. Sidewall 58 together with the interior surface 82 of end wall 56 and surface 52 of base member 26 define detection chamber 62. Sidewall 58 circumscribes detection chamber 62 with surface 52 being positioned opposite end wall 56. Depressions 42, 44 are located within detection chamber 62 whereby light emitted from LED 34 enters chamber 62 and sensor 36 measures the quantity of light reflected by smoke and similar particulate matter within chamber 62. Opening 50 is also located in chamber 62 as discussed below. Smoke detector 20 is configured to inhibit other sources of light from reaching sensor 36. The interior of chamber member 24 is illustrated in FIG. 2 and includes internal structures 80 and multifaceted interior surfaces. Light from the external environment is screened from sensor 36 by the relative positions of openings 68 and 60 and positioning of structures 80. Mesh screen 84 positioned radially inwardly of sidewall 58 also helps to block incoming light as well as preventing the entry of insects into chamber 62. The geometry of the interior of chamber 62 and the multi-faceted nature of the surfaces within the chamber are also arranged to inhibit the direct reflection of light from LED 34 to sensor 36.

When the quantity of reflected light reaching sensor 36 exceeds a threshold value, presumably because of the presence of a smoke particles in chamber 62, smoke detector 20 generates an alarm signal. This use of a light emitting source and sensor for measuring reflected light within a discharge chamber to detect the presence of smoke in the ambient air is well known to those having ordinary skill in the art. For example, smoke detectors commercially available from Bosch Security Systems, Inc., having a place of business in Fairport, N.Y., under the MAGIC.SENS brand name such as the O 300 Optical Smoke Detector and O 400 LSN Optical Smoke Detector are used to detect the presence of smoke using similar techniques and these products may be modified for use with the present invention by adding a cleaning port as described below.

The illustrated smoke detector 20 relies upon the ambient air currents to introduce air into and discharge air from detection chamber 62 while smoke detector 20 is activated and in a detection mode actively monitoring the air sample within detection chamber 62. In other words, the illustrated embodiment does not include any means for actively pumping the air being monitored through the detection chamber. In contrast, aspirator-type smoke detectors include means for pumping air into a detection chamber and will oftentimes include a filter for removing larger particulates from the air being pumped into the detection chamber.

It is desirable for the air sample contained within detection chamber 62 to have the same concentration of smoke particles as the ambient air in the environment being monitored by the smoke detector 20 to allow for the accurate monitoring of the air. Over prolonged periods of time, however, dust particles and other particulate matter may accumulate in detection chamber 62 of the smoke detector. This unwanted accumulation of particulates in detection chamber 62 can elevate the reflected light values measured by sensor 36. This elevated level of reflected light effectively lowers the particulate concentration in the ambient air that will trigger an alarm event and increases the possibility of a false alarm. For commercial smoke alarm installations, false alarms have the potential to unnecessarily cause the evacuation of a building and are highly undesirable. It is also possible for particulate matter to accumulate in chamber 62 in a manner that partially blocks the light emitted by LED 34. This can possibly increase the quantity of smoke in the air that is required to generate an alarm signal and is also undesirable.

To prevent the excessive accumulation particulate matter, detection chamber 62 may be periodically cleaned to remove accumulated particulate matter. In accordance with the present invention, smoke detector 20 has a cleaning port 86 that defines a passageway extending from an external surface of mounting plate 28 to detection chamber 62. In the illustrated embodiment, cleaning port 86 is defined by aperture 54 in mounting plate 28 and opening 50 in base member 26. A valve member 90 controls the passage of air through cleaning port 86.

Valve 90 is shown in FIGS. 3–7 and includes a distal end 92, a cylindrical central section 96 and a proximal end 94. The distal end 92 and proximal end 94 each defined by radially outwardly extending flanges 91, 93 respectively with the distal end 92 having a first diameter that is slightly larger than the second diameter of the proximal end 94. The central section 96 defines a third diameter which is smaller than the diameters of both the distal and proximal ends 92, 94. This allows valve 90 to be easily mounted in aperture 54. Aperture 54 has an internal radius that is approximately equal or slightly larger than the radius of central section 96 and smaller than the radii of the outwardly extending flanges defining distal and proximal ends 92, 94. The length of central section 96 extending between the outwardly extending flanges 91, 93 is also approximately equal to the thickness of mounting plate 28 at aperture 54. Thus, middle section 96 can be positioned within aperture 54 with flanges 91, 93 located at distal and proximal ends 92, 94 extending radially outwardly of aperture 54 on opposite sides of mounting plate 28 and thereby securing valve 90 within aperture 54. As can be seen in FIGS. 5–7, outwardly extending flange 93 defining proximal end 94 is securely engaged between base member 26 and mounting plate 28.

Figure 3:
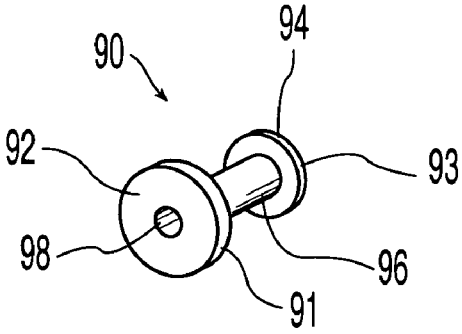
FIG. 3 is a perspective view of the valve member of the first embodiment.
Figure 4:
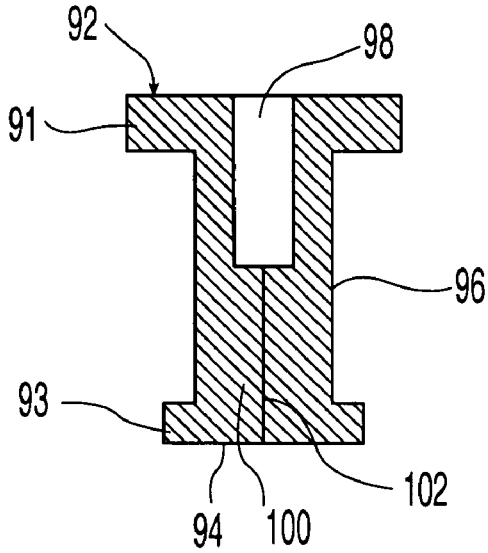
FIG. 4 is a cross sectional view of the valve member of FIG. 3.

As best seen in FIGS. 3 and 4, distal end 92 defines a central bore hole 98 which extends into middle section 96. Proximal end 94 defines a sealing member 100 which projects radially inwardly. A passage 102 is located centrally within sealing member 100. Passage 102 is normally closed and provides a substantially air-tight seal preventing the passage of air therethrough. However, by inserting an air nozzle 104 into bore 98, the combination of the physical presence of nozzle 104 in bore 98 providing a radially outwardly biasing force on sealing member 100 and the force applied by the introduction of pressurized air into bore 98 through nozzle 104 adjacent passage 102 opens passage 102 allowing air to flow through passage 102 and the remainder of cleaning port 86, i.e., opening 50, into chamber 62 as illustrated in FIG. 6. Alternatively, the air nozzle or tube on the air canister can be inserted partially or entirely through passage 102. For example, the air canister tube can be inserted through passage 102 to introduce its distal end directly into chamber 62.

The illustrated valve 90 is manufactured using a silicone rubber SHORE 45A. This provides a resilient and flexible valve member that can be easily inserted into aperture 54. After removing nozzle 104 from valve 90, the material used to form seal member 100 returns to its original configuration closing passage 102, i.e., the material used to form valve 90 is resilient. Although a specific embodiment of a valve is illustrated herein, alternative valve members may also be used with the present invention to seal cleaning port 86 to control the flow of air into chamber 62. For example, the cleaning port might have a threaded end that receives a complimentary threaded cap whereby the threaded cap forms a valve member and is easily removed, i.e., opened, to provide access to the detection chamber for cleaning purposes.

With reference to FIGS. 5–7, a process for cleaning of chamber 62 will now be described. In each of FIGS. 5–7, the ambient air surrounding smoke detector 20 is substantially free of smoke and the air sample within chamber 62 should, ideally, also be substantially free of particulate matter. FIG. 5 schematically illustrates smoke detector 20 with a relatively high concentration of accumulated particulate matter in chamber 62 and, thus, cleaning of chamber 62 is appropriate.

Initially, smoke detector 20 is removed from mounting base 30. Dismounting of smoke detector 20 serves two purposes, it exposes cleaning port 86 and also deactivates smoke detector 20 by disconnecting electrical contacts 72 from contacts 74. It is advantageous to deactivate smoke detector 20 because of the likelihood of inaccurate readings during the cleaning process and the potential to cause a false alarm. By positioning cleaning port 86 so that it faces mounting base 30 when detector 20 is mounted and thereby requiring the removal of detector 20 from mounting base 30 to expose cleaning port 86, the deactivation of smoke detector 20 prior to cleaning can be assured.

After exposing cleaning port 86, the nozzle 104 of a pressurized air canister 106 is inserted into bore hole 98 of valve 90 and air is discharged from canister 106 as shown in FIG. 6. Canister 106 may by any canister of clean pressurized air that are commonly used to clean electronic equipment and are known to those having ordinary skill in the art. The present invention is not limited to the use of such canisters, however, and alternative methods of introducing air into chamber 62 through cleaning port 86 may also be employed. As air is released through nozzle 104 into bore 98 it forces open passage 102 and enters chamber 62 through opening 50 as described above. When the pressurized air enters chamber 62 it forces the air present in chamber 62, as well as the particulate matter suspended in such air, outwardly through openings 60 in sidewall 58 and through openings 68 in outer housing 22 thereby flushing particulate matter from chamber 62. Thus, the use of cleaning port 86 with valve member 90 allows detection chamber 62 to be cleaned without disassembly of smoke detector 20. After flushing particulate matter from chamber 62 and removing nozzle 104 from cleaning port 86, smoke detector 20 is remounted on mounting base 30, electrical power is once again supplied to smoke detector 20 and it is placed in its detection mode actively monitoring the air sample contained within chamber 62 for the presence of smoke.

Although the cleaning process did involve removing and reinstallation of smoke detector 20 on mounting base 30, it did not require the opening of the housing enclosure defined by mounting plate 28 and outer housing 22 and, thus, neither printed circuit board 32 nor the interior of detection chamber 62 were exposed or subject to direct manual handling by the individual performing the cleaning process. By avoiding the exposure of printed circuit board 32 and the interior surfaces of chamber 62 during the cleaning process, i.e., by not disassembling smoke detector 20, the possibility of the individual cleaning the detector inadvertently damaging the smoke detector is substantially reduced.

FIG. 7 illustrates smoke detector 20 after particulate matter has been flushed from chamber 62 by introducing clean air into chamber through cleaning port 86. As schematically represented, not all of the particulate matter has been removed but a substantial percentage of the accumulated particulate matter was flushed from chamber 62 and the performance of smoke detector 20 will be enhanced relative to its condition prior to cleaning.

While this invention has been described as having an exemplary design, the present invention may be further modified within the spirit and scope of this disclosure. This application is therefore intended to cover any variations, uses, or adaptations of the invention using its general principles.

What is claimed is:

1. An optical smoke detector for detecting the presence of particulates in an air sample, said detector cleanable with the use of a supply of clean air introduced through an air nozzle, said smoke detector comprising:

a detection chamber defining an enclosure for the air sample;

at least one opening in fluid communication with said detection chamber whereby the air sample is introducible and dischargeable from said detection chamber through said at least one opening;

a cleaning port defining a passageway into said detection chamber from a first position external to said detection chamber; and a valve member sealing said cleaning port, said valve member being accessible from the first position external to said detection chamber, said valve member selectively openable for permitting the passage of air through said cleaning port into said detection chamber.

2. The smoke detector of claim 1 further comprising a support structure and wherein said smoke detector is releaseably mounted said support structure, said cleaning port positioned to face said support structure when said smoke detector is mounted on said support structure.

3. The smoke detector of claim 1 wherein said detection chamber is defined by a chamber member having an end wall and a sidewall extending substantially transverse to said end wall, said sidewall circumscribing the detection chamber and engaging a base member, said base member defining a surface of said detection chamber opposite said end wall; said sidewall including a plurality of circumferentially spaced outlet openings defining said at least one opening.

4. The smoke detector of claim 3 wherein said passageway defined by said cleaning port extends through said surface of said detection chamber defined by said base member.

5. The smoke detector of claim 1 wherein said valve has a distal first end and a proximal second end, said first end disposed more distally from said detection chamber than said second end, said first end of said valve defining a bore hole, said second end defining a sealing member providing a seal within said cleaning port, said sealing member defining a central passage extending from said bore hole to said second end wherein said central passage is closed in the absence of an external force and is openable to permit the passage of air when the air nozzle is introduced into said bore hole and clean air is introduced into said valve through the air nozzle.

6. The smoke detector of claim 1 wherein said valve has a substantially cylindrical central section with first and second opposite ends, said first and second ends respectively defining first and second radially outwardly extending flanges, said first and second flanges defining first and second diameters respectively, said central section of said valve positioned in an aperture having a third diameter, each of said first and second diameters being greater than said third diameter.

7. An optical smoke detector for detecting the presence of particulates in an air sample, said detector cleanable with the use of a supply of clean air introduced through an air nozzle, said smoke detector comprising:

a detection chamber defining an enclosure for the air sample;

a plurality of openings in communication with said detection chamber whereby, during operation of said smoke detector in a detection mode, the air sample is introduced into said detection chamber through at least one of said openings and is discharged from said detection chamber through another one of said openings solely by ambient air movement;

a cleaning port defining a passageway into said detection chamber from a first position external to said smoke detector; and a resilient valve member sealing said cleaning port, said valve member being accessible from said first position external to said smoke detector, said valve member selectively openable for permitting the passage of air through said cleaning port into said detection chamber by actuating said valve member with the air nozzle.

8. The smoke detector of claim 7 wherein said smoke detector is adapted for mounting on a support structure, said cleaning port positioned to face the support structure when said smoke detector is mounted on the support structure.

9. The smoke detector of claim 7 wherein said detection chamber is defined by a chamber member having an end wall and a sidewall extending substantially transverse to said end wall, said sidewall circumscribing said detection chamber and engaging a base member, said base member defining a surface of said detection chamber opposite said end wall, said plurality of openings being defined by said sidewall.

10. The smoke detector of claim 9 wherein said passageway defined by said cleaning port extends through said surface of said detection chamber defined by said base member.

11. The smoke detector of claim 7 wherein said valve has a distal first end and a proximal second end, said first end disposed more distally from said detection chamber than said first end, said second end defining a sealing member providing a seal within said cleaning port, said sealing member defining a central passage extending from said bore hole to said second end wherein said central passage is closed in the absence of an external force and is openable to permit the passage of air when the air nozzle is introduced into said bore hole and clean air is introduced into said valve through the air nozzle.

12. The smoke detector of claim 7 wherein said valve has a substantially cylindrical central section with first and second opposite ends, said first and second ends respectively defining first and second radially outwardly extending flanges, said first and second flanges defining first and second diameters respectively, said central section of said valve positioned in an aperture having a third diameter, each of said first and second diameters being greater than said third diameter.

13. A method of cleaning an optical smoke detector that detects the presence of particulates in an air sample, said method comprising:

providing the smoke detector with a detection chamber for enclosing the air sample and a cleaning port defining a passageway to the detection chamber from a first position external to the smoke detector;

controlling the passage of air through the cleaning port with a valve member, the valve member sealing the cleaning port during operation of the smoke detector in a detection mode; and opening the valve and introducing clean air into the detection chamber through the cleaning port to flush particulates from the detection chamber.

14. The method of claim 13 wherein the step of opening the valve and introducing clean air into the detection chamber comprises introducing the nozzle of a canister of pressurized air into the cleaning port and discharging air from the canister.

15. The method of claim 13 further comprising deactivating the smoke detector prior to opening the valve and introducing clean air into the detection chamber.

16. The method of claim 13 wherein the smoke detector is mounted on a support structure and the method further comprises removing the smoke detector from the support structure prior to the step of opening the valve and introducing clean air into the detection chamber.

17. The method of claim 16 wherein the cleaning port faces the support structure when the smoke detector is mounted to the support structure.

18. The method of claim 16 wherein removing the smoke detector from the support structure deactivates the smoke detector.

19. The method of claim 13 wherein the step of opening the valve and introducing clean air into the detection chamber does not require exposure of internal surfaces of the detection chamber.

* * * * *